United States Patent [19]

Lange

[11] Patent Number: 4,697,738

[45] Date of Patent: Oct. 6, 1987

[54] ELECTRICALLY ACTUATABLE FUEL-INJECTION VALVE FOR INTERNAL COMBUSTION ENGINES

[75] Inventor: Jürgen Lange, Eschborn, Fed. Rep. of Germany

[73] Assignee: VDO Adolf Schindling AG, Frankfurt am Main, Fed. Rep. of Germany

[21] Appl. No.: 861,482

[22] Filed: May 9, 1986

[30] Foreign Application Priority Data

May 13, 1985 [DE] Fed. Rep. of Germany ..... 3517257

[51] Int. Cl.[4] ..... B05B 3/14; B05B 15/00; B05B 7/06

[52] U.S. Cl. ..... 239/102.2; 239/132.5; 239/424.5; 261/DIG. 48

[58] Field of Search ..... 239/102.2, 104, 132.5, 239/424, 424.5, 425, 434.5; 310/340, 367, 369; 261/DIG. 48

[56] References Cited

U.S. PATENT DOCUMENTS 2,907,648 10/1959 Chapman ..... 261/DIG. 48 X 2,908,443 10/1959 Fruengel ..... 261/DIG. 48 X 4,372,491 2/1983 Fishgal ..... 239/102.2

*Primary Examiner*—Andres Kashnikow

*Assistant Examiner*—Patrick N. Burkhart

*Attorney, Agent, or Firm*—Martin A. Farber

[57] ABSTRACT

An electrically actuatable fuel-injection valve for internal combustion engines has a piezoelectric hollow-cylindrical radial vibrator (11) within the wall (30) of which a number of continuous fuel-receiving chambers (12, 12') are arranged parallel and concentric to a longitudinal axis (19) of the radial vibrator. Each of the chambers (12, 12') is in communication at one open end with a fuel feed path and at its other open end has an ejection opening in the form of a bore (27, 27'). A passage line (passage bore 29) for a stream of air which conducts at least a part of the stream of intake air is conducted through the radial vibrator (11) concentrically to the longitudinal axis of the radial vibrator. The passage line terminates, open, approximately at the level of the injection openings.

6 Claims, 2 Drawing Figures

ELECTRICALLY ACTUATABLE FUEL-INJECTION VALVE FOR INTERNAL COMBUSTION ENGINES

RELATED APPLICATIONS

My related co-pending applications are Ser. Nos. 06/861483 an 06/861484 both field May 9, 1986.

FIELD AND BACKGROUND OF THE INVENTION

The present invention relates to an electrically actuatable fuel-injection valve for internal combustion engines. It is suitable for the following proposed valve.

An electrically actuatable fuel-injection valve for internal combustion engines has a piezoelectric hollow cylindrical radial vibrator within the wall of which a plurality of fuel-receiving chambers are arranged parallel and concentric to a longitudinal axis of the radial vibrator, each of which chambers is in communication at one open end with a fuel feed path while at the other open end it has an ejection opening (=outlet opening).

This object is an electrically actuatable fuel-injection valve for internal combustion engines which is characterized by the fact that it has a piezoelectric vibrator with electrodes and at least one fuel-receiving chamber, and that in fuel conducting communication with the chamber there are a fuel feed path and an ejection opening which are so developed that when voltage is applied to the electrodes the fuel is imparted a preferred movement through the chamber to the ejection opening. Specifically, as piezoelectric vibrator there is provided a hollow cylindrical radial vibrator within the wall of which a number of continuous fuel-receiving chambers are arranged parallel and concentric to a longitudinal axis of the radial vibrator.

With the piezoelectric vibrator as well as the fuel feed path which is in communication with it as well as the ejection opening, which at the same time is the outlet opening of the vibrator, the fuel-injection valve is, without any element which is movable as a whole and in particular without a longitudinally displaceable valve needle, to determine the preferred movement of the liquid fuel, namely the direction of injection, and at the same time to feed the measured amount of fuel and create the prerequisite for atomization of the fuel. This is achieved in the manner that upon the application of electrical voltage to electrodes of the piezoelectric vibrator the latter contracts or expands as a result of the electrical field so that the volume of the fuel-receiving chamber changes, that upon a change in volume of the chamber the fuel emerges essentially from the ejection opening while the return flow of fuel through the fuel feed path is substantially throttled.

In general, in order to achieve a substantial mixing of air and fuel it is desirable that the fuel-injection valve produce an atomized fuel jet which is as wide as possible. In known fuel-injection valves it has been attempted to achieve this by various structural measures, the fuel jet, however, being regularly injected in the longitudinal axis of the fuel-injection valve from the valve into the surrounding volume. If the fuel-injection valve is located, as in central injection systems, completely within the stream of air drawn in by the internal combustion engine, said stream of air moves past the outside of the fuel-injection valve and, due to its flow velocity, counteracts the desired widening of the jet of fuel.

SUMMARY OF THE INVENTION

It is an object of the invention to remedy this defect in an electrically actuatable fuel-injection valve having a piezoelectric hollow cylindrical radial vibrator of the above-mentioned type, i.e. to give off an atomized jet of fuel which is as wide as possible even if the fuel-injection valve is located in a stream of air flowing around it.

According to the invention, a passage line (passage bore 29) for a stream of air passes through the radial vibrator (11)′ concentric to its longitudinal axis (19), said line terminating open approximately at the height of the injection openings (holes 17, 17′). Since in the radial vibrator used the fuel-receiving chambers and the associated ejection openings are located at a distance from the longitudinal axis of the fuel-injection valve, an additional stream of air can be passed through the inner region of the fuel-injection valve without disturbing the operation of the piezoelectric vibrator, in particular the imparting of a preferred direction of movement to the liquid fuel, the feeding of the measured amount of fuel or the atomizing of the fuel. Rather, the atomized jet of fuel which emerges from the ejection opening is picked up by the stream of air which emerges from and widens outside the passage line, the jet expanding approximately transverse to the longitudinal axis. In this way there is obtained a good mixing of the fuel and of the intake air which is fed as stream of air through the passage line and as air flowing around the fuel-injection valve as a whole. It is essential that the ejection openings at the chambers, which openings are at the same time the outlet openings of the chambers, be flowed around on all sides by air, as a result of which the fuel injected into the surrounding stream of air is thoroughly mixed. Since the fuel-injection valve is flowed around by air not only on the outside but also in its passage line, a good cooling of the fuel-injection valve is furthermore obtained and the formation of vapor bubbles in the fuel is reduced.

One particularly advantageous embodiment of the electrically actuatable fuel-injection valve in which the piezoelectric hollow cylindrical radial vibrator is mounted in a block from which in particular the fuel feed path which is in communication with the fuel-receiving chambers is formed consists in a central passage bore (29) being formed as passage line for the stream of air from the block (18) in a longitudinal axis (19), this embodiment being characterized by great compactness and good mechanical properties. The block, which is provided for the mounting of the ring vibrator and also has the fuel feed path is provided with a central passage bore whose wall is in part concentrically surrounded by the radial vibrator. The passage bore does not result in any substantial additional expense upon the manufacture of the block.

With an additionally outwardly widening bevel on that end of the passage-line or passage-bore which is adjacent the ejection opening or outlet openings of the chambers, the result is obtained that undesired eddying in the region of the stream of air emerging from the passage line is substantially avoided.

Further according to the invention, the passage line (passage bore 29) for the stream of air has a bevel (31) at its lower end adjacent the ejection openings (bores 17, 17′) of the fuel-receiving chambers (12, 12′) said bevel widening outward in the main direction of flow (34) of the stream of air.

Further according to the invention, in that end of the passage line or passage bore (29) for the inner stream of air which is adjacent the ejection openings (bores 17, 17') there is a cone (32) which widens in the main direction of flow (34) of the stream of air and the conical surface of which preferably forms a slot with the bevel (31).

By this additionally provided cone at the outlet end of the passage line or passage bore there is formed, preferably in combination with the bevel of the passage line or of the passage bore, an approximately frustoconical slot in which the inner stream of air is precisely guided so that after emergence from the slot it widens substantially conformally with the latter without strong eddying.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

The fuel-injection valve has been shown greatly enlarged in both figures.

Figure 1:
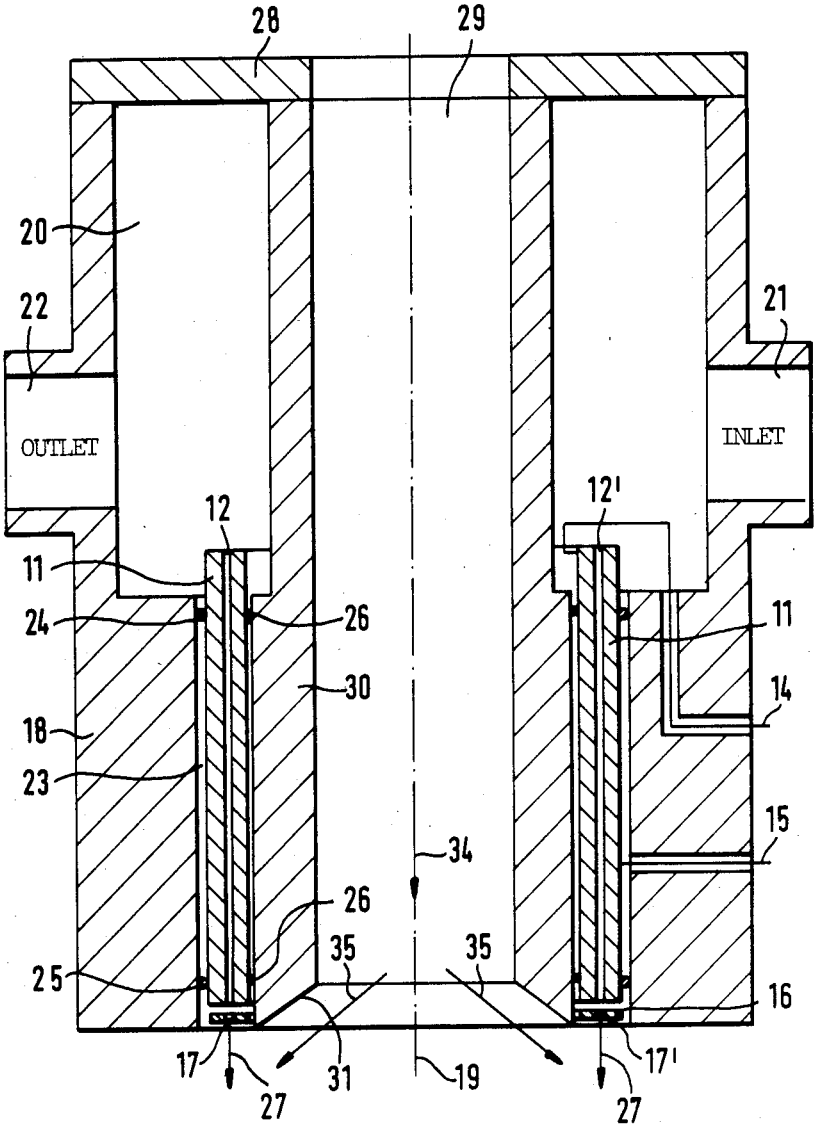
FIG. 1 is a longitudinal sectional view of a first embodiment of the fuel-injection valve having a radial vibrator and a passage bore for an inner stream of air.
Figure 2:
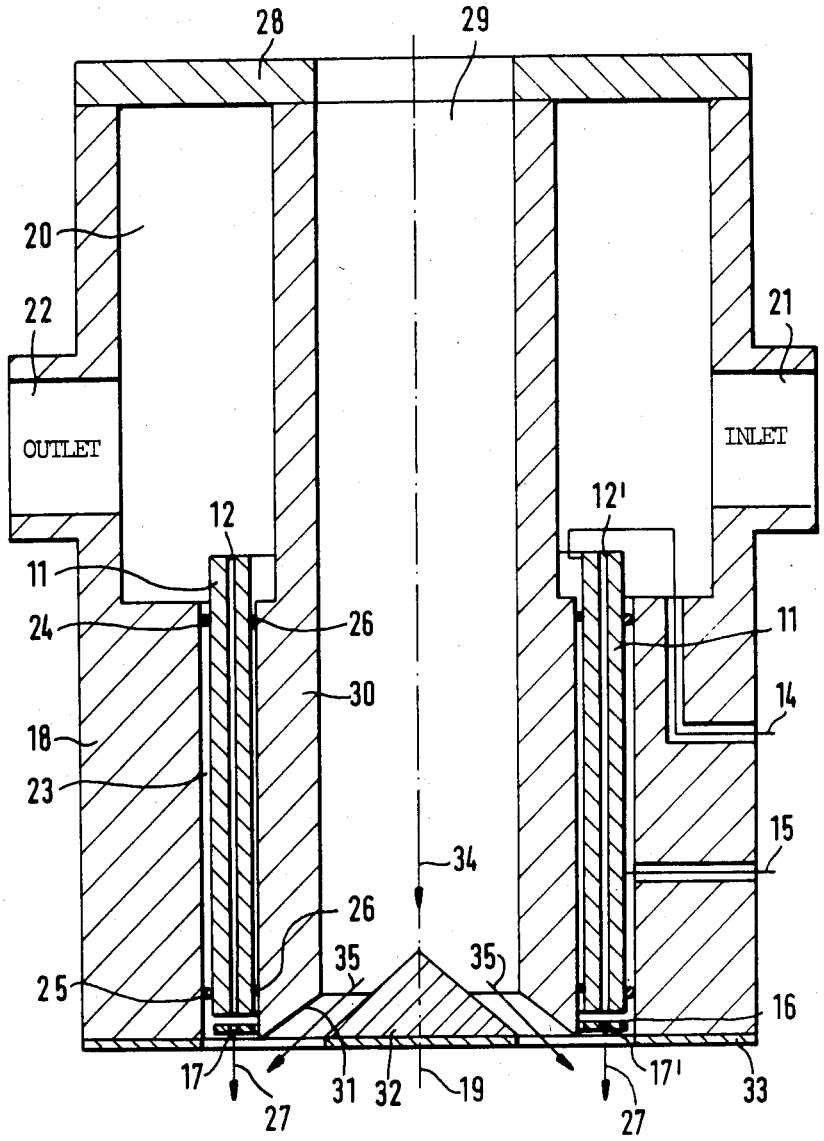
FIG. 2 is a longitudinal sectional view of a second embodiment of the fuel-injection valve which is developed substantially in accordance with FIG. 1 but has a central cone at one end of the passage bore.

An essential part of an embodiment of the fuel-injection valve according to FIGS. 1 and 2 is a hollow cylindrical radial vibrator 11 of piezoelectric material. Within the hollow cylindrical radial vibrator, between its inner wall and the outer wall, there are arranged a number of fuel-receiving chambers 12, 12'. The fuel-receiving chambers lie in a neutral arc of the radial vibrator and are developed as continuous bores, and therefore open on top and on bottom, of constant diameter. They extend parallel and concentric to the longitudinal axis 19.

Both the inner wall and the outer wall of the radial vibrator are provided with an electrode, which is merely indicated by the lead wires 14 and 15 respectively.

The bottom of the fuel-receiving chambers 12, 12' is opposite an annular diaphragm 16 which has bores 17, 17' which determine the droplet size and are aligned with the chambers.

The radial vibrator and the annular diaphragm are mounted in a block 18 so that the bores 17, 17' of the annular diaphragm 16 and the chambers of the radial vibrator 11 can inject fuel downward.

The fuel feed path to the annular vibrator is arranged in the upper part of the rigid block, which is substantially of symmetry of rotation around the longitudinal axis 19 and preferably consists of metal. The fuel feed path consists essentially of an annular constant-volume chamber 20 into which a fuel feed nipple 21 and a fuel discharge nipple 22 debouch. The free cross sections of the nipples 21 and 22 are small as compared with the area of the inner wall of the constant-volume chamber.

The radial vibrator 11 is sealed by packings 24–26 in an annular recess 23 of the block 18.

An upper cover 28 covers the block 18, in particular over the constant-volume chamber, so that the latter is to this extent closed off.

Through the cover 18 and the block 18 there extends a passage bore 29 which is arranged concentric to the longitudinal axis 19. In this way, a wall 30 is formed between the passage bore and the radially outward adjoining parts, the constant-volume chamber 20 and the annular recess 23. Since the block preferably consists of metal, the wall 30 is a good conductor of heat.

At its lower opening, the passage bore has a bevel of outwardly conically widening shape, as which can be noted from FIGS. 1 and 2.

The embodiment according to FIG. 2 differs from that of FIG. 1 by an additional cone 32 whose conical surface, together with the bevel 31, preferably forms a substantially annular slot the shape of which can be noted in detail from FIG. 2. The cone 32 is held fast in its position with respect to the block 18, for which purpose a lower plate 33 can be used.

When electrical voltage is applied to the feed lines 14, 15 and the electrical field is formed accordingly between the inner wall and the outer wall of the radial vibrator, a change of volume of the chambers 12, 12' in the ring vibrator takes place. The fuel flowing into these fuel-receiving chambers from the constant-volume chamber 20 is injected essentially downward through the bores 17, 17' of the annular diaphragm 16 into the volume surrounding the fuel-injection valve. The preferred direction of movement 27 of the fuel thus is that indicated by the corresponding arrow in the drawing. However, the fuel cannot flow back upward substantially from chambers 12, 12' into the constant-volume chamber 20 since the latter is filled with a large volume of substantially non-compressible fuel. The fuel-receiving chambers 12, 12' can therefore be developed as a continuous bore, in a manner favorable for manufacture.

The lead wires 14, 15 are conducted out of the block 18 to a connector (not shown) via which a controlled electric voltage can thus be fed to the radial vibrator.

Upon the operation of the internal combustion engine for which the fuel-injection valve of FIGS. 1 and 2 is intended, the valve is flowed around by intake air, from the top to the bottom as seen in the drawing. A part of the intake air is conducted through the passage bore 29 with the main direction of flow indicated by an arrow 34. Upon emergence from the passage bore, the inner stream of intake air widens outward, as indicated by the arrows 35. This widened inner stream of intake air carries along with it also the atomized fuel which has been injected into the space of the stream of intake air and which emerges initially with the preferred direction of movement 27 from the bores 17, 17' of the annular diaphragm 16. The fuel is thereby mixed intensely with the stream of intake air, the mixture expanding further outwards. In advantageous manner, as a result of the bevel 31 in FIG. 1 and in still more effective manner by the cone 32 in FIG. 2 at most a slight undesired eddying takes place in advantageous manner in the region of the annular diaphragm and of the adjoining surfaces.

I claim:

1. An electrically actuatable fuel-injection throttle for internal combustion engines comprising:

a piezoelectric hollow cylindrical radial vibrator, there being a plurality of fuel-receiving chambers disposed within a wall of the vibrator and arranged parallel and concentric to a longitudinal axis of the vibrator;

a fuel feed conduit, each of said chambers being in communication at one open end with said conduit;

an ejection opening disposed at the opposite open end of each of said chambers; and wherein a passage bore for a stream of air extends through the radial vibrator concentric to its longitudinal axis, said bore having an open termination approximately at the height of the injection openings (holes).

2. The electrically actuatable fuel-injection throttle according to claim 1 wherein said piezoelectric hollow cylindrical radial vibrator is mounted in a block from which, in particular, said fuel feed conduit is formed, said passage bore conducting a stream of air from the block along a longitudinal axis.

3. The electrically actuatable fuel-injection throttle according to claim 2, wherein said passage bore for the stream of air has a bevel at its lower end adjacent the ejection openings of the fuel-receiving chambers, said bevel widening outward in the main direction of flow of the stream of air.

4. The electrically actuatable fuel-injection throttle according to claim 1, wherein said passage bore for the stream of air has a bevel at its lower end adjacent the ejection openings of the fuel-receiving chambers, said bevel widening outward in the main direction of flow of the stream of air.

5. The electrically actuatable fuel-injection throttle according to claim 1, wherein a cone is located in the end of the passage bore adjacent the ejection openings, and wherein said cone widens in the main direction of flow of the stream of air and has a conical surface.

6. The electrically actuable fuel-injection throttle according to claim 5, wherein said conical surface forms a slot with the bevel.

* * * * *